United States Patent [19]

Kurtz et al.

[11] 4,221,635

[45] Sep. 9, 1980

[54] PULP FEED FOR A PAPERMAKING MACHINE

[75] Inventors: Rüdiger Kurtz, Immenstaad; Wolfgang Trudel, Bad Waldsee both of Fed. Rep. of Germany .

[73] Assignee: Escher Wyss GmbH, Ravensburg, Fed. Rep. of Germany

[21] Appl. No.: 964,135

[22] Filed: Nov. 27, 1978

[30] Foreign Application Priority Data

Dec. 13, 1977 [CH] Switzerland ..... 15282/77

[51] Int. Cl.[2] ..... D21F 1/02

[52] U.S. Cl. ..... 162/343; 162/344

[58] Field of Search ..... 162/343, 344

[56] References Cited

U.S. PATENT DOCUMENTS

| | | | |
|---|---|---|---|
| 3,360,428 | 12/1967 | Loynd | 162/344 X |
| 3,725,197 | 4/1973 | Dahl et al. | 162/343 |
| 3,923,593 | 12/1975 | Verseput | 162/343 X |
| 4,089,739 | 5/1978 | Hildrebrand | 162/343 |
| 4,137,124 | 1/1979 | Bubik et al. | 162/343 |

FOREIGN PATENT DOCUMENTS

| | | | |
|---|---|---|---|
| 2607822 | 8/1977 | Fed. Rep. of Germany | 162/344 |
| 2623648 | 11/1977 | Fed. Rep. of Germany | 162/343 |

*Primary Examiner*—Richard V. Fisher

*Attorney, Agent, or Firm*—Werner W. Kleeman

[57] ABSTRACT

A pulp feed for a papermaking machine comprising a guide block having guide channels through which parallelly flows the pulp or stock suspension and a nozzle channel which merges with the guide block. The nozzle channel terminates at an outlet gap for the efflux of the pulp and is bounded by two lip plates. In order to adjust the size of the gap in a direction towards and away therefrom, while maintaining a constant angle of the lip plates relative to one another and in relation to the guide block, these lip plates are displaceable. There is fixedly secured at the guide block at least one rigid partition or divider wall which, in the flow direction of the pulp, divides the nozzle channel along its entire length into partial cross-sectional regions, wherein the relationship of the cross-sections of such cross-sectional regions, in a direction perpendicular to the flow direction of the pulp or stock suspension is essentially constant.

9 Claims, 4 Drawing Figures

PULP FEED FOR A PAPERMAKING MACHINE

BACKGROUND OF THE INVENTION

The present invention relates to a new and improved construction of a pulp feed for a papermaking machine.

Generally, the pulp feed for a papermaking machine of the present development is of the type comprising a guide block having guide channels through which parallelly flows the pulp or stock suspension, typically a slurry of fibers in a liquid carrier. A nozzle channel merges with the guide block, the nozzle channel terminating at an outlet gap for the efflux of the pulp and being delimited by two lip plates. These plates are displaceable so that there can be adjusted the size of the gap, both towards and away from such gap while maintaining a constant angle of the lip plates relative to one another and with respect to the guide block.

A pulp feed of this type has been disclosed, by way of example, in West German Patent Publication No. 2,607,822.

SUMMARY OF THE INVENTION

It is a primary object of the present invention to improve upon this known pulp feed apparatus.

Another and more specific object of the present invention aims at providing a new and improved construction of pulp feed wherein the flow of the pulp or stock suspension can be guided with simple means up to the region of the outlet gap in a manner such that, for instance, there is maintained a layering or plying of the stock, which is present in the direction of flow of the stock or pulp, up to the outlet gap.

Yet a further significant object of the present invention aims at a new and improved construction of pulp feed which is relatively simple in design, economical to manufacture, extremely reliable in operation, and allows for controlled flow of the pulp towards an outlet gap of the pulp feed.

Now in order to implement these and still further objects of the invention, which will become more readily apparent as the description proceeds, the pulp feed of the present development is manifested by the features that at the guide block there is fixedly secured at least one rigid partition or divider wall. This partition wall, viewed in the direction of flow of the pulp, divides the nozzle channel along its entire length into partial cross-sectional regions, wherein the relationship of the cross-section of such cross-sectional regions, measured essentially perpendicular to the flow direction of the pulp, is essentially constant.

In this connection reference should be specifically made to the West German Patent Publication No. 2,623,648 where there has already been proposed extending the guide channels up to the region of the outlet gap. This construction, which must fulfill the strictest requirements, is however, complicated.

On the other hand, in U.S. Pat. No. 3,923,593, granted Dec. 2, 1975, there is disclosed a pulp feed having partition or divider walls and equipped with a laterally pivotable lip, by means of which it is possible to regulate the size of the outlet gap. Owing to the pivotability of the lip these partition walls likewise must be pivotably arranged in the nozzle channel, in order to be able to automatically accommodate themselves to the varying cross-sectional relationships of the nozzle channel. However, the danger exists that oscillation phenomenon will arise, such as for instance fluttering of the partition walls and so forth, which adversely affect the fabricated paper web.

With the inventive apparatus, the particular manner of guiding the lip plates enables an arrangement of rigid, immobile partition or divider walls. This is associated with the advantage that, on the one hand, they are simpler, since they do not require any pivotal mounting structure, and, on the other hand, are less susceptible to oscillations. At the same time, upon transition from the guide channels into the partial cross-sectional regions of the nozzle channel there is obtained a favorable turbulence or vorticity, such as is known from the structure of FIGS. 7 to 11 of U.S. Pat. No. 3,725,197, granted Apr. 3, 1973.

Preferably, the relationship of the flow cross-sections of the nozzle channel to both sides of the partition wall can be the same as the relationship of the sum of the flow cross-sections of the related guide channels of the guide block. In this case the same flow velocities and the same pressure drops in the guide channels also lead to the same velocities of the stock suspension in the individual cross-sections or cross-sectional regions of the nozzle channel formed by the partition wall or partition walls. Consequently, the requisite regulation can be appreciably simplified.

The partition wall can be mechanically secured between flat guide elements. In relation to the flow of the pulp or stock suspension, these guide elements are attached at the downstream end of the guide block and contain portions or sections of guide channels which merge with the guide channels of the guide block. In this way it is possible, with very simple means, to obtain a good and rigid anchoring of the partition walls in the nozzle channel.

Moreover, the guide elements can be attached at the guide block. The partition wall or further partition walls located between the guide elements together with the guide elements can be connected by connection elements with the outer guide elements. The connection elements extend transversely with respect to the flow direction of the pulp through the partition walls and engage with the guide elements. In this way there is realized a simple arrangement which can be easily assembled and dismantled.

Between the partition walls and the guide elements there can be inserted spacer strips or equivalent structure. These render possible the exchange of the partition walls and the use of partition walls of different thickness, in order for instance to influence their oscillation behavior.

The partition wall can be provided at its downstream end with a tapered portion delimited by converging side surfaces. The course of the side surfaces is chosen such that the partial cross-sectional regions located to both sides of the partition wall, become increasingly smaller in the direction of the outlet gap along the entire length of the converging side surfaces. In this way there is obtained a faultless guiding of the pulp flow, and there is not adversely affected the fine turbulence or vorticity of the pulp which exists in such pulp or stock flow.

There can also be preferably arranged at the side surfaces of the outer guide elements and which confront the lip plates lateral cover plates, for instance formed of sheet metal. These lateral cover plates lead to inclined boundary walls of the nozzle channel and have a short portion or section which bears against the related boundary wall. As a result, there is augmented, in known manner, the faultless flow of the pulp or the like through the nozzle channel.

The guide channels formed in the guide block and in the guide elements can be provided in conventional manner with at least one sudden-like i.e., step-like widened portion in the manner of a so-called step diffuser. Such type guide channels, known for instance from the aforementioned U.S. Pat. No. 3,725,197, granted Apr. 3, 1973, are particularly suitable for forming the desired fine turbulence of the stock suspension.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
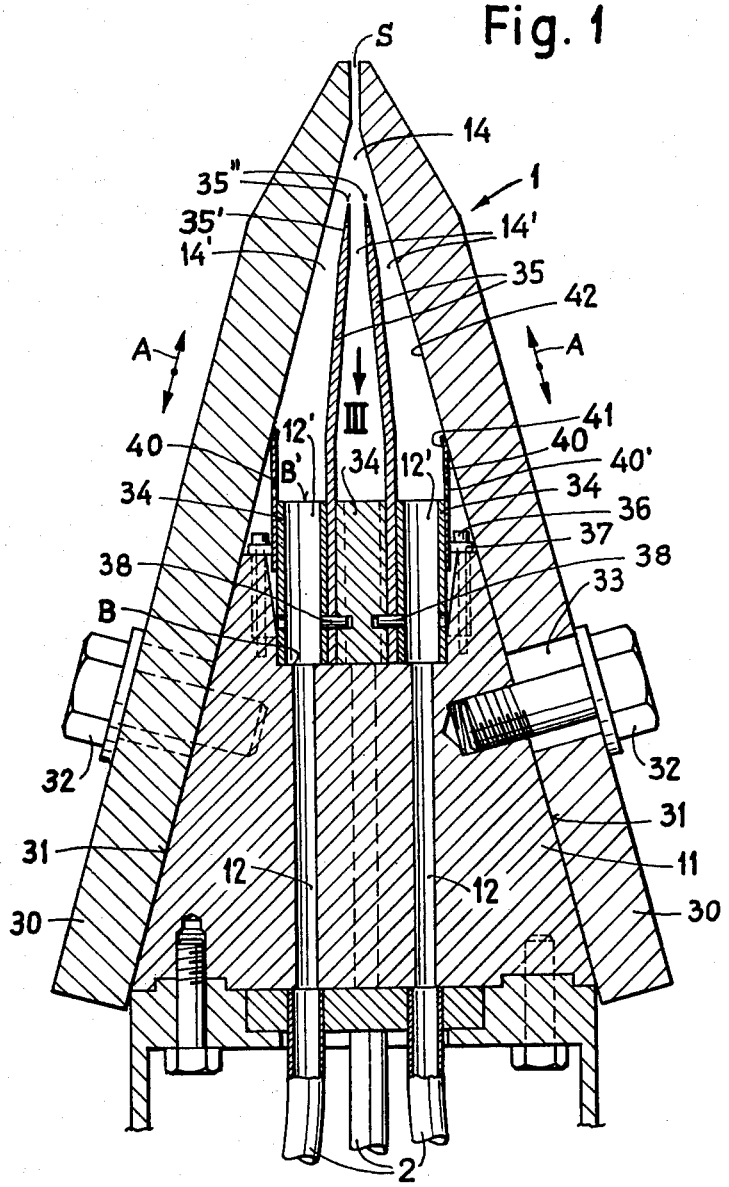
FIG. 1 is a schematic sectional view of a pulp feed constructed according to the teachings of the present invention.

Describing now the drawings, in FIG. 1 there is illustrated an exemplary embodiment of pulp feed or pulp feed apparatus—sometimes referred to in the art as a headbox—which is connected with distributor pipes or conduits 2 to which there is delivered the pulp or stock suspension from a not particularly illustrated common infeed conduit or a number of infeed conduits, which are likewise connected with not particularly illustrated pumps equipped with motors as is well known in this particular field of technology. The pulp feed or pulp feed apparatus, generally designated by reference character 1, will be seen to contain a guide block 11 in which there are formed guide channels 12 connected with the infeed or distributor conduits 2. These guide channels 12 lead to a nozzle channel 14 which is delimited by the lip plates 30 or equivalent structure, to be discussed more fully hereinafter. From the nozzle channel 14 the flow of pulp or stock suspension emanates through an outlet or outfeed gap S in the form of a jet or stream which is deposited onto a conventional screen or at an intermediate space between two not particularly illustrated screens or sieves.

As best seen by referring to FIG. 1, the two lip plates 30 are attached at the guide block 11. These lip plates 30 or equivalent structure, for the purpose of changing the size of the outfeed gap S, formed by their downstream located ends, can be moved to-and-fro in the direction of the indicated arrows along the flat guide surfaces 31 of the block 11. The connection or attachment of the lip plates 30 at the guide block 11 can be accomplished by threaded bolts or screws 32 or equivalent structure and elongate holes 33 and has only been schematically shown. Of course, other suitable techniques for securing the lip plates 30 at the guide block 11 can be used. It is preferable to provide for the purpose of postionally adjusting, as desired, the lip plates 30 lever mechanisms of the type, for instance, disclosed in the aforementioned West German Patent Publication No. 2,607,822, to which reference may be readily had, wherein at the same time it is advantageous to insure that both lip plates 30 can be similarly moved in a manner such that the outlet or outfeed gap S always remains symmetrical. If the one lip plate is slightly shifted in relation to the other lip plate, then there is formed a deflection of the outgoing jet, which, under circumstances, may be intentional.

Continuing, and also as best seen by referring to FIG. 1, guide elements 34 are arranged at the guide block 11. Between these guide elements 34 there are located one or a number of partition walls 35, here there being shown two such partition or divider walls 35. The outer guide elements 34 are secured by means of screws or threaded bolts 36 and contact ledges 37, or equivalent structure, at the guide block 11. The intermediate guide element 34 is connected by pins 38 or the like with the outer guide elements 34. These pins 38 extend through the partition walls 35 and likewise fixedly retain the same in this manner.

Additionally, with the showing of FIG. 1, the outer guide elements 34 are provided with lateral cover plates 40, for instance formed of sheet metal, although not necessarily of such material. These cover plates 40 extend parallel to one another and to the direction of flow of the pulp or stock suspension up to the related boundary wall 42 of the nozzle channel 14. These boundary walls 42 are formed by the inner walls of the lip plates 30. Moreover, each of such cover plates 40 has a short section or portion 41 which merges therewith and bears against the related wall 42 of the lip plates 30. For pressure compensation purposes the cover plates 40 can be provided with openings 40'.

The guide elements 34 are provided with portions or sections 12' constituting extensions of the guide channels 12 and merging therewith. In accordance with the illustrated exemplary embodiment the diameter of the sections 12' is greater than that of the guide channels 12 formed in the guide block 11, so that between the guide channel sections 12 and the sections 12' there is formed a step-like jump or widening B, in the manner known from the aforementioned U.S. Pat. No. 3,725,197, granted Apr. 3, 1973, resulting in a uniform, fine turbulence of the pulp or stock suspension. At the transition between the sections 12' and the partial cross-sections or cross-sectional portions 14' of the nozzle channel 14 there is present a further jump or widening B'.

The partition or divider walls 35 are structured such that they divide the nozzle channel 14, in the flow direction of the pulp or stock suspension, into the sections or portions 14', in other words the partial cross-sectional portions or regions, whose cross-sectional relationship, measured perpendicular to the flow direction of the pulp, is essentially constant. In accordance with the illustration of FIG. 1, the size of each cross-sectional region 14' corresponds to about one-third of the corresponding cross-section of the nozzle channel 14 at the related location thereof. As also seen from the showing of FIG. 1, the partial cross-sectional portions 14' also have associated therewith correspondingly proportional cross-sections of the guide channels or portions 12, 12'.

As also still further seen by referring to FIG. 1, each partition wall 35 is provided at its downstream end with a tapered portion composed of converging side surfaces 35' and terminating at a sharp end 35''. The course of the side surfaces 35' is chosen such that the partial cross-sections 14' located to both sides of the partition wall, become increasingly smaller in the direction of the outlet gap S along the entire length of the converging side surfaces 35'. Due to these measures there is avoided that there will be formed any additional turbulence of the pulp shortly before the outlet gap S, which could cause an increase of the transverse transport of the suspended particles in the direction of the plane of the drawing. This is important for instance during the fabrication of multi-ply paper if there are infed to the different distributor or infeed pipes 2 pulp stock of different quality.

Figure 2:
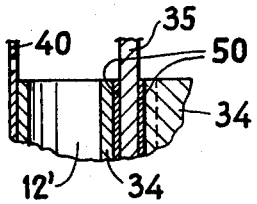
FIG. 2 is a fragmentary sectional view, on an enlarged scale, showing a detail of the arrangement of FIG. 1.

Now in FIG. 2, constituting a section of the arrangement of FIG. 1 on an enlarged scale, there are inserted between the partition or divider walls 35 and the guide elements 34 spacer strips 50 or equivalent structure. These spacer strips 50, which are fixedly retained in position in the same manner as the partition walls 35 by the pins 38 or equivalent attachment elements, enable exchanging the partition walls 35 for others having a different thickness. By appropriately selecting the thickness of the partition walls 35 it is possible to influence the flow behavior at the partial cross-sectional regions 14' or also the oscillation behavior of the partition walls in the product flow of the pulp.

Figure 3:
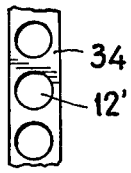
FIGS. 3 and 4 are respective fragmentary views of two modifications of the pulp feed of FIG. 1, looking in the direction of the arrow III thereof.
Figure 4:
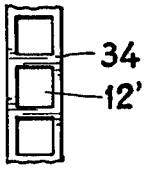

Finally, in FIGS. 3 and 4 there are shown two different possibilities for constructing the channel sections or portions 12' in the guide elements 34. Specifically, with the showing of FIG. 3 the channel sections 12' are circular cylindrical in shape, while in FIG. 4 they have a square cross-sectional shape. However, it is to be specifically understood that also other cross-sectional shapes are possible, such as for instance hexagonal.

As already mentioned, the distributor pipes 2 all can be connected with a common infeed pipe or conduit, which all have infed thereto pulp of the same quality. However, the distributor pipes 2, leading to the individual partial cross-sectional portions 14' of the nozzle channel 14, can be connected at separate infeed pipes which infeed pulp of different quality. In this way it is possible to fabricate, for instance with the inventive apparatus, multiply paper.

While there are shown and described present preferred embodiments of the invention, it is to be distinctly understood that the invention is not limited thereto, but may be otherwise variously embodied and practiced within the scope of the following claims.

What we claim is:

1. A pulp feed for a papermaking machine, comprising:

a guide block provided with guide channels through which essentially parallelly flows the pulp;

means defining a nozzle channel which merges and flow communicates with the guide block;

said nozzle channel terminating at an outlet gap for the efflux of the pulp;

said means defining said nozzle channel including two lip plates;

means for displaceably mounting said lip plates in a direction towards and away from said outlet gap in order to adjust the size of said outlet gap, while maintaining essentially a constant angle of said lip plates relative to one another and in relation to said guide block;

at least one rigid partition wall;

means for fixedly securing said at least one rigid partition wall at said guide block so as to extend in the direction of flow of the pulp, said means for fixedly securing comprising at least one pin which extends through the partition wall and is connected to said guide block;

said partition wall dividing the nozzle channel along substantially its entire length into partial cross-sectional regions;

and the relationship of the cross-sections of said cross-sectional regions, in a direction essentially perpendicular to the direction of flow of the pulp, being essentially constant.

2. The apparatus as defined in claim 1, wherein:

the relationship of the flow cross-sections of the cross-sectional regions of the nozzle channel to both sides of the partition wall is essentially equal to the relationship of the sum of the flow cross-sections of the related guide channels of the guide block.

3. The apparatus as defined in claim 1, wherein:

said partition wall is provided at a downstream end thereof with a tapered portion bounded by converging side sufaces;

the course of the side surfaces being selected such that the partial cross-sectional regions of the nozzle channel and located to both sides of the partition wall become increasingly smaller in the direction of the outlet gap along the entire length of the converging side surfaces.

4. The apparatus as defined in claim 1, wherein:

said guide channels include at least one step-like widened portion.

5. The apparatus as defined in claim 1, wherein:

said partition wall extends substantially over the entire width of the papermaking machine.

6. A pulp feed for a papermaking machine, comprising:

a guide block provided with guide channels through which essentially parallelly flows the pulp;

means defining a nozzle channel which merges and flow communicates with the guide block;

said nozzle channel terminating at an outlet gap for the efflux of the pulp;

said means defining said nozzle channel including two lip plates;

means for displaceably mounting said lip plates in a direction towards and away from said outlet gap in order to adjust the size of said outlet gap, while maintaining essentially a constant angle of said lip plates relative to one another and in relation to said guide block;

at least one rigid partition wall;

means for fixedly securing said at least one rigid partition wall at said guide block so as to extend in the direction of flow of the pulp;

said partition wall dividing the nozzle channel along substantially its entire length into partial cross-sectional regions;

the relationship of the cross-sections of said cross-sectional regions, in a direction essentially perpendicular to the direction of flow of the pulp, being essentially constant;

said securing means comprises a plurality of substantially flat guide elements between which there is secured said partition wall;

said guide elements being secured at a downstream end of the guide block with respect to the direction of flow of the pulp; and said guide elements each containing a guide section merging with a related guide channel of the guide block.

7. The apparatus as defined in claim 6, including:

means for securing the guide elements adjacent one another at the guide block;

said means for fixedly securing the partition wall at the guide block comprises connection element means for connecting the partition wall with at least one outer located one of the guide elements; and said connection element means extending through the partition wall transversely with respect to the direction of flow of the pulp and engaging with the guide elements.

8. The apparatus as defined in claim 6, further including:

spacer strip means inserted between the partition wall and the guide elements.

9. The apparatus as defined in claim 6, further including:

lateral cover plate means arranged at side surfaces of the outermost ones of the guide elements and which side surfaces confront the lip plates;

said lip plates including inclined boundary walls delimiting said nozzle channel;

said cover plate means extending up to the region of the inclined boundary walls of the nozzle channel; and said cover plate means having a short section bearing against the related boundary wall of the nozzle channel.

* * * * *